US008213854B2

(12) United States Patent
Iida et al.

(10) Patent No.: US 8,213,854 B2
(45) Date of Patent: Jul. 3, 2012

(54) SHEET PROCESSING SYSTEM

(75) Inventors: Junichi Iida, Kanagawa (JP); Shinya Kitaoka, Kanagawa (JP); Shuuya Nagasako, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 12 days.

(21) Appl. No.: 12/585,502

(22) Filed: Sep. 16, 2009

(65) Prior Publication Data

US 2010/0072692 A1 Mar. 25, 2010

(30) Foreign Application Priority Data

Sep. 22, 2008 (JP) ..... 2008-242307

(51) Int. Cl.
*B65H 31/22* (2006.01)

(52) U.S. Cl. ..... 399/405; 399/407; 399/408; 399/410; 270/58.08; 271/272; 271/207

(58) Field of Classification Search ..... 399/407, 399/408, 410; 270/58.08; 271/272, 207
See application file for complete search history.

(56) References Cited

U.S. PATENT DOCUMENTS

| | | | | |
|---|---|---|---|---|
| 6,785,507 | B2 * | 8/2004 | Asai et al. | 399/391 |
| 6,957,810 | B2 | 10/2005 | Yamada et al. | |
| 7,134,654 | B2 | 11/2006 | Yamada et al. | |
| 7,198,268 | B2 | 4/2007 | Yamada et al. | |
| 7,207,556 | B2 | 4/2007 | Saitoh et al. | |
| 7,306,214 | B2 | 12/2007 | Iida et al. | |
| 7,331,572 | B2 | 2/2008 | Yamada et al. | |
| 7,407,155 | B2 | 8/2008 | Tamura et al. | |
| 7,410,158 | B2 | 8/2008 | Iida et al. | |
| 7,416,177 | B2 | 8/2008 | Suzuki et al. | |
| 7,510,177 | B2 * | 3/2009 | Nagata et al. | 270/58.08 |
| 7,515,871 | B2 * | 4/2009 | Mae et al. | 399/407 |
| 2003/0215275 | A1 | 11/2003 | Tamura et al. | |
| 2004/0256783 | A1 | 12/2004 | Iida et al. | |
| 2006/0022394 | A1 | 2/2006 | Tamura et al. | |

FOREIGN PATENT DOCUMENTS

| | | | |
|---|---|---|---|
| JP | 2002-372817 | | 12/2002 |
| JP | 2003104623 | A * | 4/2003 |
| JP | 2004-155566 | | 6/2004 |
| JP | 2005-345541 | | 12/2005 |
| JP | 3768900 | | 2/2006 |
| JP | 2006-193283 | | 7/2006 |
| JP | 2006-206271 | | 8/2006 |
| JP | 2006-248684 | | 9/2006 |
| JP | 2006-248686 | | 9/2006 |
| JP | 3898358 | | 1/2007 |
| JP | 2007-308211 | | 11/2007 |
| JP | 2008007305 | A * | 1/2008 |
| JP | 2008110834 | A * | 5/2008 |

OTHER PUBLICATIONS

Abstract of JP 2000-118841 published Apr. 25, 2000.
Abstract of JP 2002-338117 published Nov. 27, 2002.

* cited by examiner

*Primary Examiner* — Michael McCullough
*Assistant Examiner* — Luis A Gonzalez
(74) *Attorney, Agent, or Firm* — Harness, Dickey & Pierce, P.L.C.

(57) ABSTRACT

A sheet pre-processing device includes a space portion as a sheet receiving unit that receives a pre-processed sheet, a first sheet conveying path for discharging the sheet to the sheet receiving unit, and a second sheet conveying path for reversing the sheet. A sheet post-processing device is removably attached into the space portion. When the sheet post-processing device is attached into the space portion, a conveying path and a reversing path works are provided, which are switched over by a switching unit.

13 Claims, 18 Drawing Sheets

SHEET PROCESSING SYSTEM

CROSS-REFERENCE TO RELATED APPLICATIONS

The present application claims priority to and incorporates by reference the entire contents of Japanese Patent Application No. 2008-242307 filed in Japan on Sep. 22, 2008.

BACKGROUND OF THE INVENTION

1. Field of the Invention

The present invention relates to a sheet processing system including a sheet processing device having a space portion as a sheet discharge unit, a sheet post-processing device removably attached into the space portion, and a sheet reversing path.

2. Description of the Related Art

A sheet post-processing such as punching, binding, and sorting performed on an image-formed sheet of paper is increasingly required of recent image forming systems. However, a sheet post-processing device that performs the sheet post-processing thereon is connected to an outer side surface of an image forming apparatus of a type that discharges the sheet from the side surface of the body of the apparatus. This configuration causes an installation space of the image forming system to be increased.

On the other hand, there are image forming apparatuses of a type that has a space portion within the installation area (inside the body of the apparatus) of the image forming apparatus and discharges a sheet of paper into the space portion, and some of the image forming apparatuses have various types of sheet post-processing devices attached into the space portion, as disclosed in Japanese Patent Application Laid-open No. 2006-206271, Japanese Patent Application Laid-open No. 2004-155566, and Japanese Patent No. 3898358.

Provided in the image forming apparatus is a plurality of sheet feeding units in order to form an image on one side or on both sides of the sheet. A switching unit is also provided therein to appropriately switch one sheet feeding unit to another for use according to a process mode.

One of the conventional image forming apparatuses is explained below. This image forming apparatus has a configuration in which various types of sheet post-processing devices can be attached into the space portion and images can be formed on both sides of the sheet.

FIG. 11 is a front view of an external configuration of the conventional image forming apparatus. The image forming apparatus is composed of a sheet feeding unit A, an image forming unit B, and an image reading unit C. Provided below the image reading unit C is a space portion D in which sheets of paper image-processed by the image forming unit B are discharged and stored. A sheet discharge unit D1 is provided in a lower part of the space portion D, and the sheets are sequentially discharged and stacked on the sheet discharge unit D1.

FIG. 12 is a schematic for explaining an internal configuration and an operation of a sheet conveying path in the image forming apparatus in FIG. 11. The sheet conveying path includes conveying roller pairs 1 and 2 being a feeding unit that forms a first sheet conveying path along which a sheet S of paper stacked in the sheet feeding unit A is fed; conveying roller pairs 5, 7, 8, and 9 that form a second sheet conveying path for reversing the sheet; an image transfer portion 3 of the image forming unit B that forms an image on the sheet; a sheet-discharge roller pair 4 that discharges the sheet onto the sheet discharge unit D1 in the space portion D; a reversing roller pair 6 that is made to rotate forwardly and reversely so as to reverse the sheet when an image is formed on both sides of the sheet; and a switching claws t1 to t3 that are switching units for switching one sheet conveying path to another for use and provided at respective guiding branches.

Operations when an image is formed on one side of the sheet in the image forming apparatus in FIG. 12 are explained below with reference to FIGS. 13A and 13B.

First, the image forming unit B acquires image information from an external device or from the image reading unit C, and processes the image information. Then, as shown in FIG. 13A, the sheet S is conveyed from the sheet feeding unit A to the image transfer portion 3 in the image forming unit B by the conveying roller pairs 1 and 2 in the first sheet conveying path, and an image forming process is performed therein. Thereafter, as shown in FIG. 13B, a sheet S1 which is the sheet S with the image formed on its one side is guided by the switching claw t1 to a sheet discharge path, and the sheet S1 is discharged onto the sheet discharge unit D1 in the space portion D by the sheet-discharge roller pair 4 in the sheet discharge path.

Operations when images are formed on both sides of the sheet are explained below with reference to FIGS. 14A to 14E.

As shown in FIG. 14A, the sheet S is conveyed from the sheet feeding unit A to the image transfer portion 3 in the image forming unit B, where an image is formed on the sheet S, and the sheet S1 is sent to a vertical conveying path by the switching claw t1. As shown in FIG. 14B, the sheet S1 is conveyed to the reversing path by a conveying guide formed with the conveying roller pair 5 and the switching claw t2. As shown in FIG. 14C, the sheet S1 is continuously conveyed by the reversing roller pair 6. However, when the trailing edge of the sheet S1 passes through the switching claw t2, as shown in FIG. 14D, the switching claw t2 is switched and further the reversing roller pair 6 is reversed, and the sheet S1 is thereby switched back and starts to be conveyed to a right-side conveying path. Thereafter, the sheet S1 is conveyed to a vertical reversing path by the switching claw t3, and is continuously conveyed as it is by the conveying roller pairs 7, 8, and 9. The sheet S1 again passes through the conveying roller pair 2, and, as shown in FIG. 14E, an image is formed on the other side of the sheet S1 at the image transfer portion 3. Thereafter, the sheet S1 is fed to a sheet discharge path by the switching claw t1, and is discharged on the sheet discharge unit D1 in the space portion D by the sheet-discharge roller pair 4.

Next, operations when a sheet discharge tray E is attached to an outer upper portion of the image forming apparatus and the sheet is discharged onto the sheet discharge tray E are explained with reference to FIGS. 15A to 15C.

As shown in FIG. 15A, the sheet S is conveyed from the sheet feeding unit A to the image transfer portion 3 in the image forming unit B, where an image is formed on the sheet S. The sheet S1 is sent to the vertical conveying path by the switching claw t1, and is once conveyed to the reversing path by the conveying guide formed with the conveying roller pair 5 and the switching claw t2. The sheet S1 is continuously conveyed by the reversing roller pair 6. However, as shown in FIG. 15B, when the trailing edge of the sheet S1 passes through the switching claw t2, the switching claw t2 is switched and further the reversing roller pair 6 is reversed, and the sheet S1 is thereby switched back and starts to be conveyed to the right-side conveying path. Thereafter, as shown in FIG. 15C, the sheet S1 passes through the switching claw t3, and is sequentially stacked on the sheet discharge tray E with its imaged side down by a sheet discharge roller 10 provided in the sheet discharge tray E.

FIG. 16 is a schematic of the image forming apparatus when an additional sheet discharge unit U is attached thereinto. The additional sheet discharge unit U includes a sheet-discharge roller pair 13 and an additional sheet-stacking tray D2. The additional sheet-stacking tray D2 can be additionally provided in the space portion D of the image forming apparatus in the downstream side of the reversing roller pair 6 in the sheet conveying direction.

Thus, in both-side printing, when the sheet is to be reversed upon discharge of the sheet onto the sheet discharge tray E, the reversing roller pair 6 and the sheet-discharge roller pair 13 perform the same operation, and the sheet S is received on the additional sheet-stacking tray D2, so that the sheet can be reversed. Furthermore, by setting a sheet discharge destination to the additional sheet discharge unit U, the additional sheet-stacking tray D2 can be set and used as another sheet discharge destination which is different from the sheet discharge unit D1 being an ordinary sheet discharge destination.

In the conventional technologies, if the sheet post-processing device can be attached into the space portion (in-body space) in the image forming apparatus, an image forming system including the sheet post-processing device requires only an installation area equivalent to that for a single unit of the image forming apparatus. Thus, this system can achieve significant space saving as compared with an image forming system in which the sheet post-processing device is connected to the outside of the image forming apparatus.

As explained with reference to FIGS. 11 to 16, the image forming apparatus is in many cases provided with a sheet reversing path to form images on both sides of the sheet. In this case, after the image processing is performed on the both sides of the sheet or when the sheet is conveyed to the sheet post-processing device through the sheet reversing path, the conveying paths are too long if there is nothing to be done for the conveying paths. Thus, there is high possibility that some trouble may occur during sheet conveyance.

SUMMARY OF THE INVENTION

It is an object of the present invention to at least partially solve the problems in the conventional technology.

According to one aspect of the present invention, there is provided a sheet processing system including a sheet pre-processing device and a sheet post-processing device. The sheet pre-processing device includes a space portion as a sheet receiving unit that receives a pre-processed sheet, a first sheet conveying path for discharging the sheet to the sheet receiving unit, and a second sheet conveying path for reversing the sheet after a part of the sheet is discharged to the sheet receiving unit. The sheet post-processing device is removably attached into the space portion. The sheet processing system further includes: a conveying path for receiving the sheet from the second sheet conveying path and conveying the sheet to the sheet post-processing device when the sheet post-processing device is attached into the space portion; a reversing path for receiving the sheet from the second sheet conveying path and reversing a sheet conveying direction when the sheet post-processing device is attached into the space portion; and a switching unit that switches over the sheet conveying direction to either one of the conveying path and the reversing path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a sheet processing system according to the present invention are explained in detail below with reference to the accompanying drawings. It should be noted that in the following explanation, the same numerals are assigned to those corresponding to the components explained with reference to FIGS. 11 to 16, and detailed explanation thereof is omitted.

Figure 1:
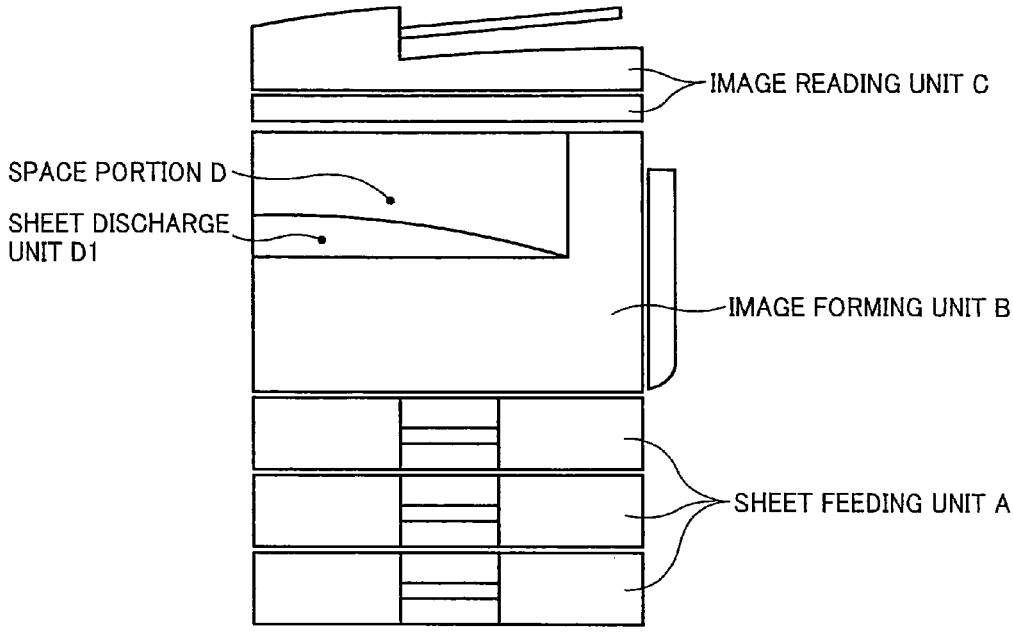
FIG. 1 is a front view of an external configuration of an image forming apparatus according to an embodiment of the present invention.

FIG. 1 is a front view of an external configuration of an image forming apparatus according to an embodiment of the present invention. The image forming apparatus is composed of the sheet feeding unit A, the image forming unit B, and the image reading unit C. Provided below the image reading unit C is the space portion D being a paper reception portion in which sheets of paper image-processed by the image forming unit B are discharged and stored, and the sheet discharge unit D1 is provided in a lower part of the space portion D. The sheets are sequentially discharged and stacked on the sheet discharge unit D1.

Figure 2:
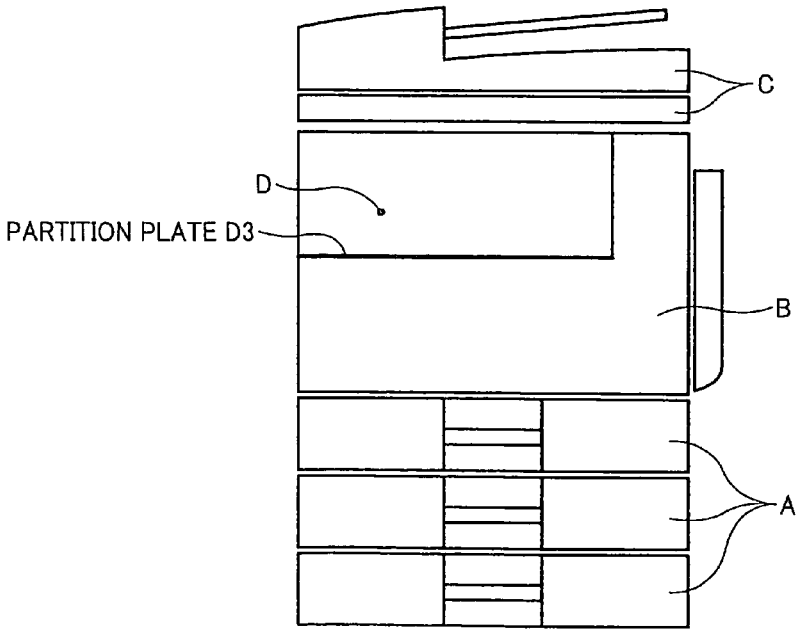
FIG. 2 is a front view of a state in which a sheet discharge unit is removed from a space portion provided in the image forming apparatus.

In the image forming apparatus according to the embodiment, as shown in FIG. 2, the sheet discharge unit D1 is removable from the space portion D in the image forming apparatus, so that the space of the space portion D can be maximally kept to attach the sheet post-processing device for post-processing the sheet into the space portion D. The sheet discharge unit D1 also has a function of covering the inside of the image forming unit B. Therefore, after the sheet discharge unit D1 is removed, a partition plate D3 is used to cover the inside of the image forming unit B for protection.

Figure 12:
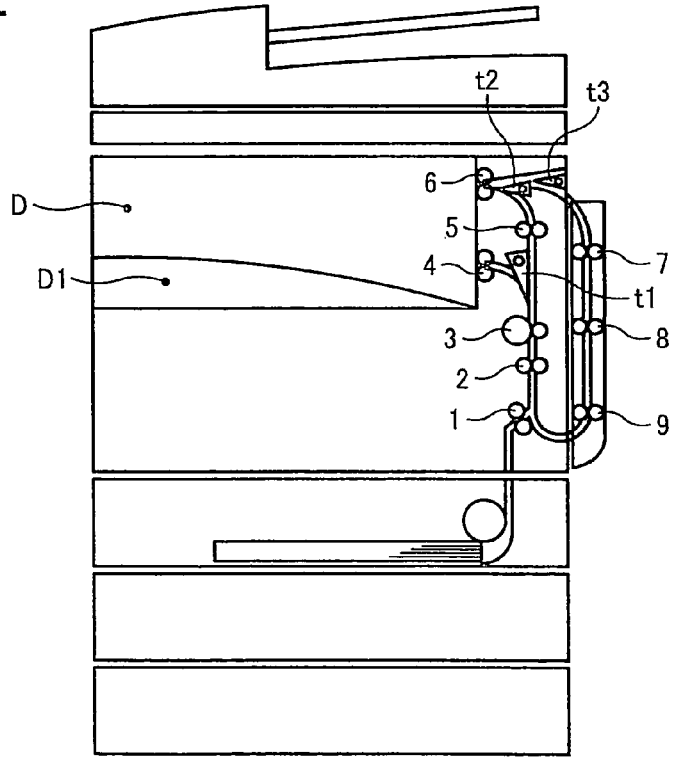
FIG. 12 is a schematic for explaining an internal configuration and an operation of a sheet conveying path in the image forming apparatus in FIG. 11.
Figure 13A:
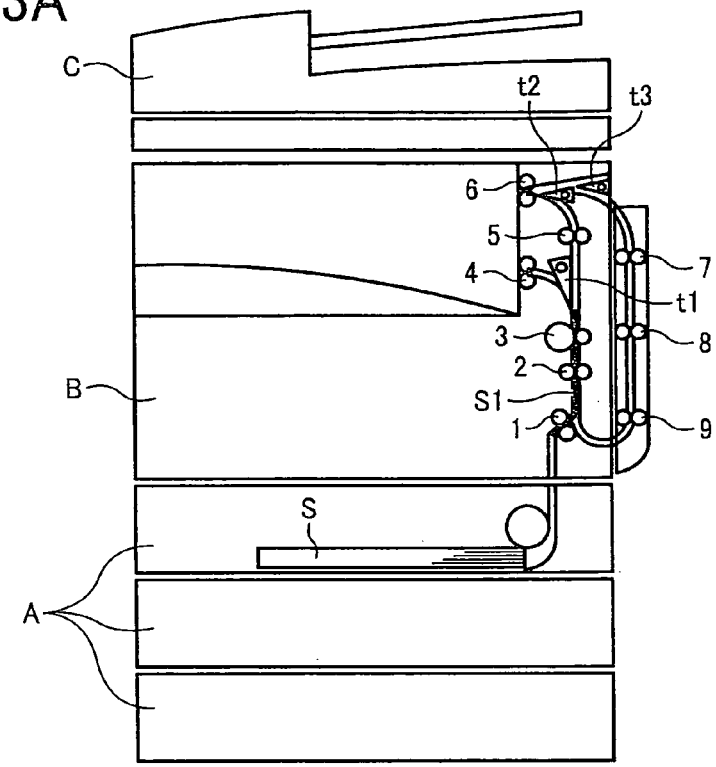
FIGS. 13A and 13B are schematics for explaining operations when an image is formed on one side of the sheet in the image forming apparatus in FIG. 12.
Figure 13B:
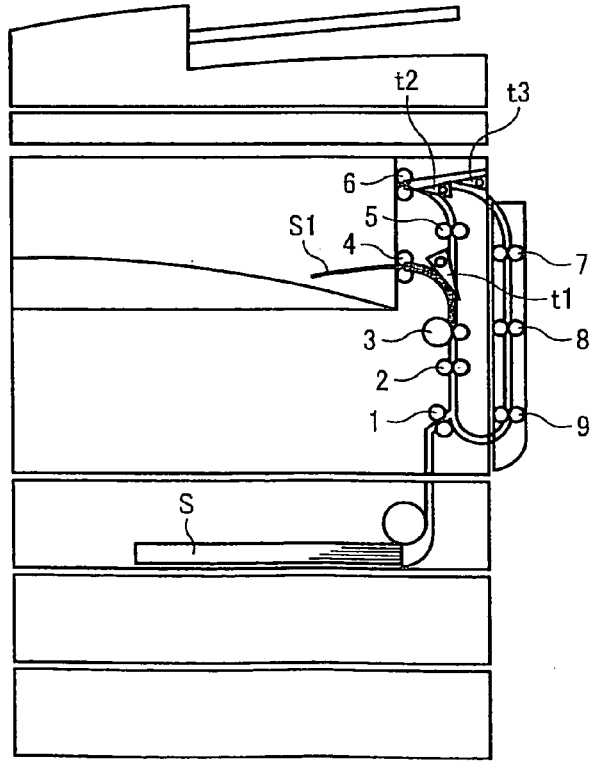
Figure 14A:
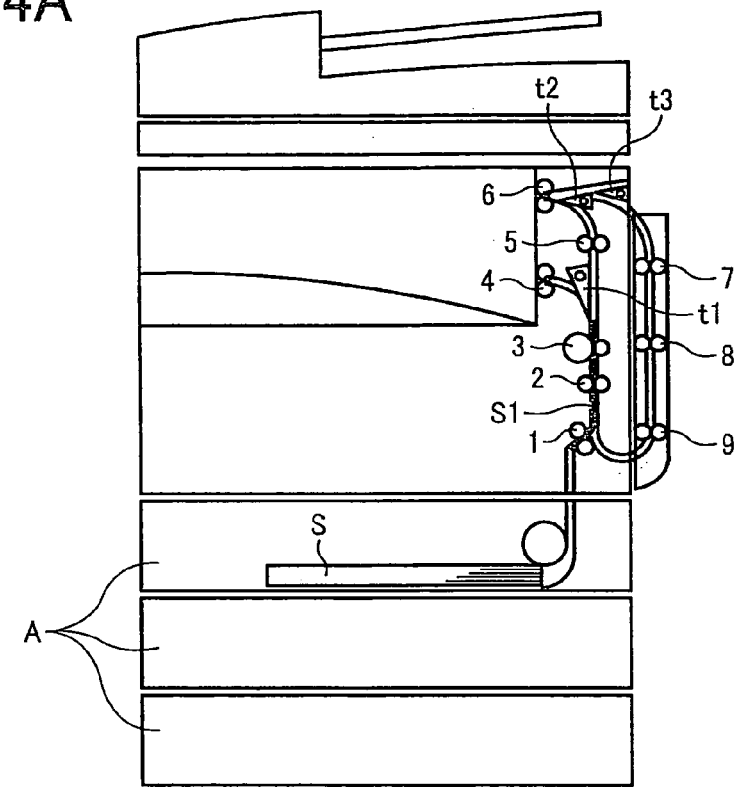
FIGS. 14A to 14E are schematics for explaining operations when images are formed on both sides of the sheet in the image forming apparatus in FIG. 12.
Figure 14B:
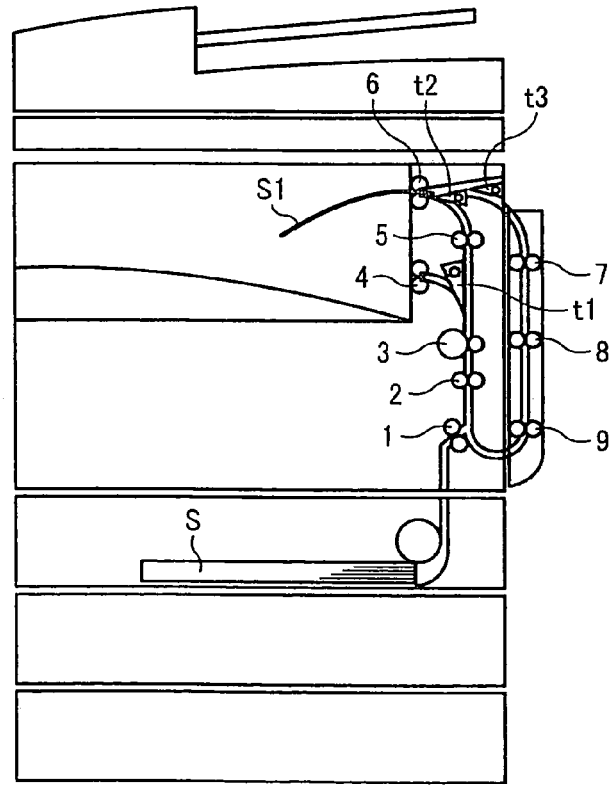
Figure 14C:
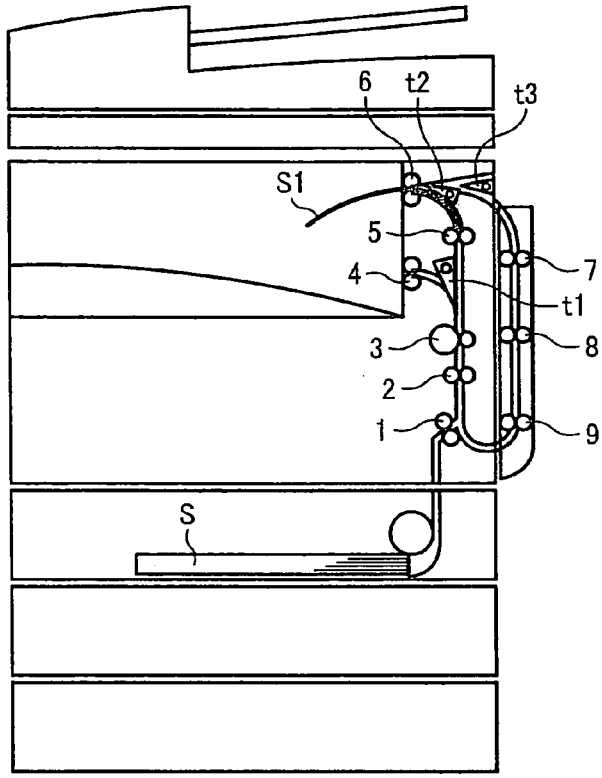
Figure 14D:
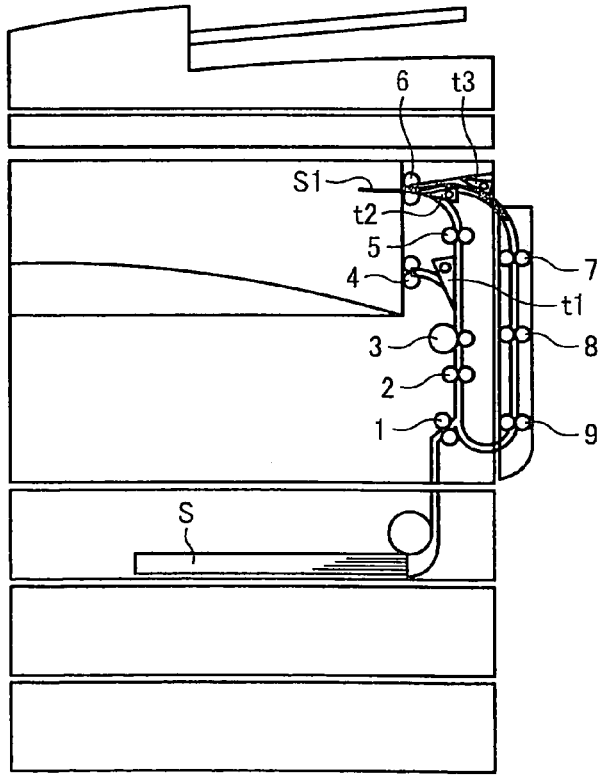
Figure 14E:
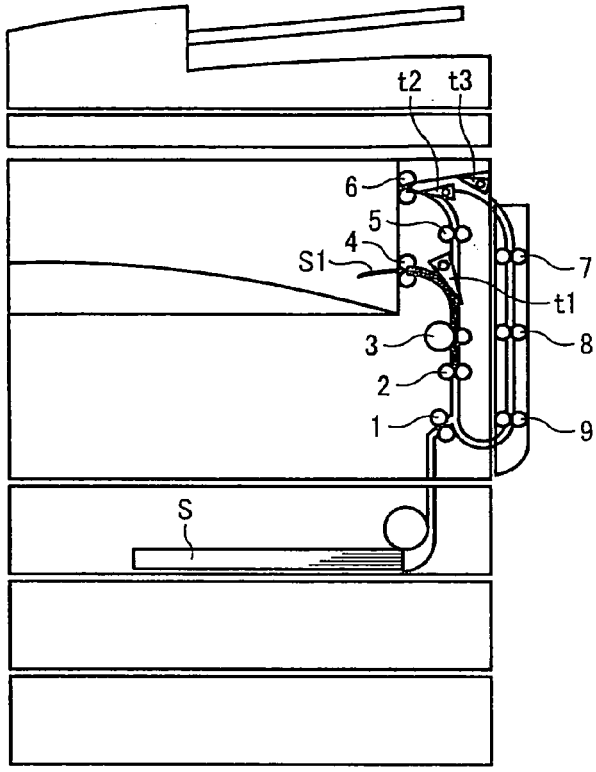
Figure 15A:
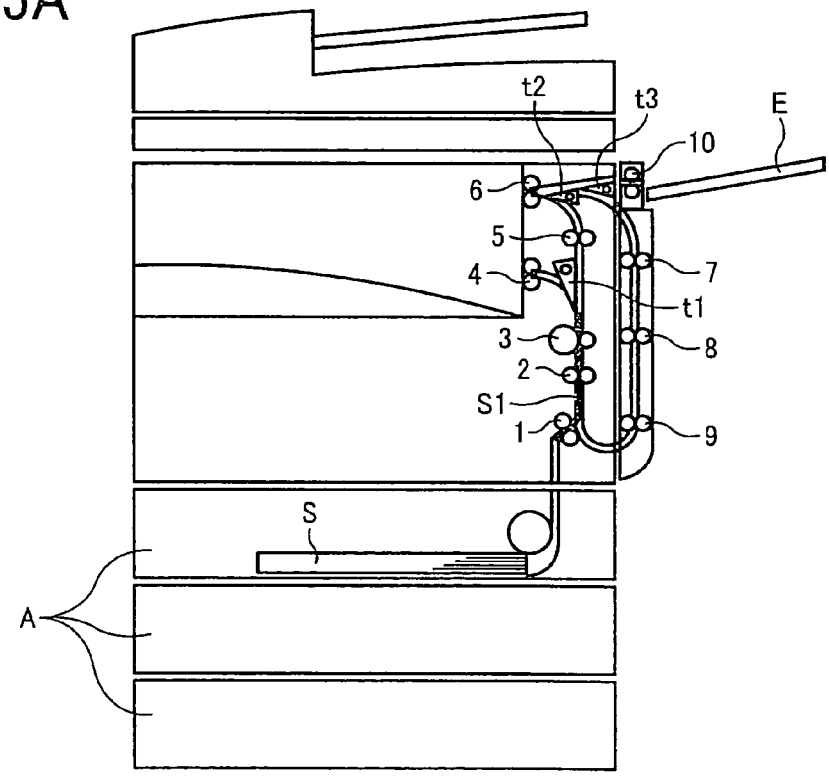
FIGS. 15A to 15C are schematics for explaining operations when the sheet is discharged onto the sheet discharge tray provided outside of the image forming apparatus in FIG. 12.
Figure 15B:
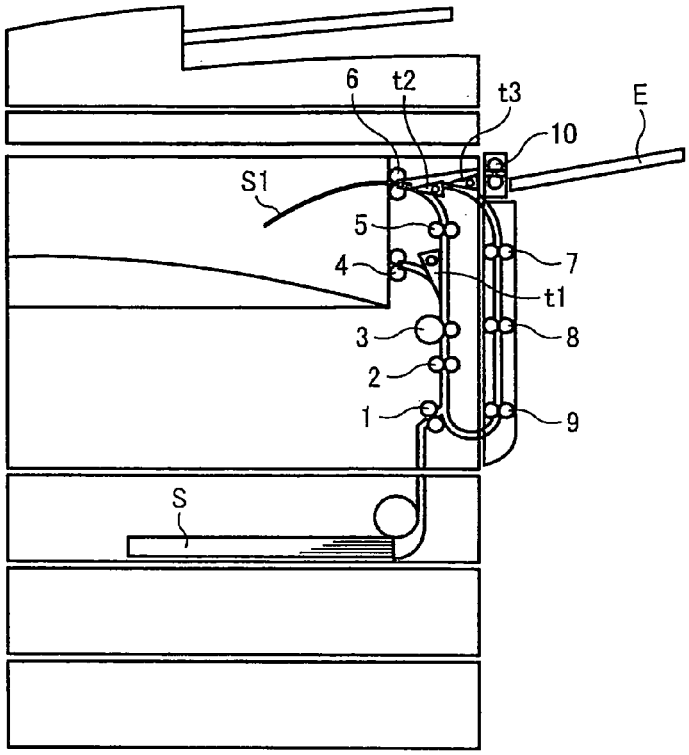
Figure 15C:
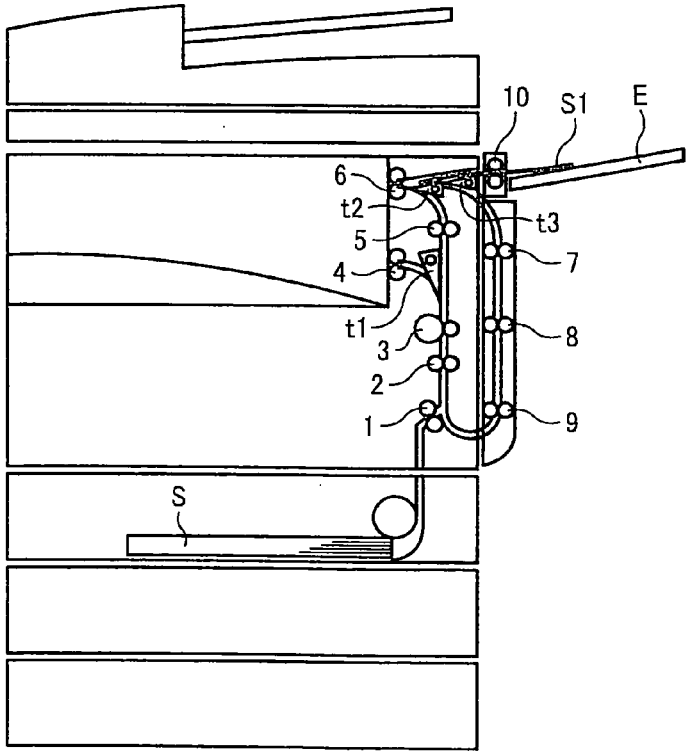
Figure 16:
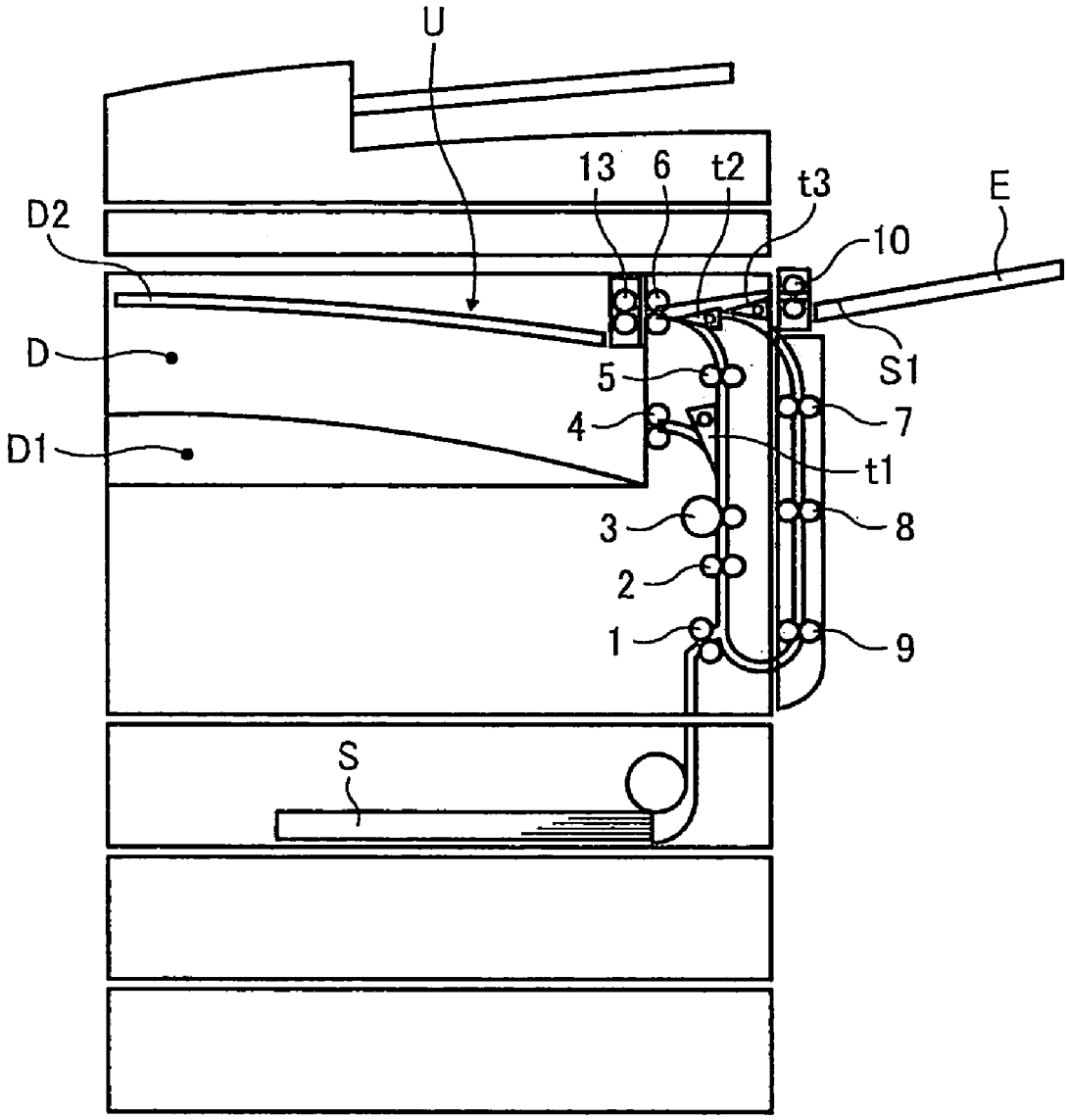
FIG. 16 is a schematic of the image forming apparatus in FIG. 12 when an additional sheet discharge unit is attached thereinto.

The internal configuration of the sheet conveying path in the image forming unit B side is the same as that shown in FIG. 12.

Figure 3A:
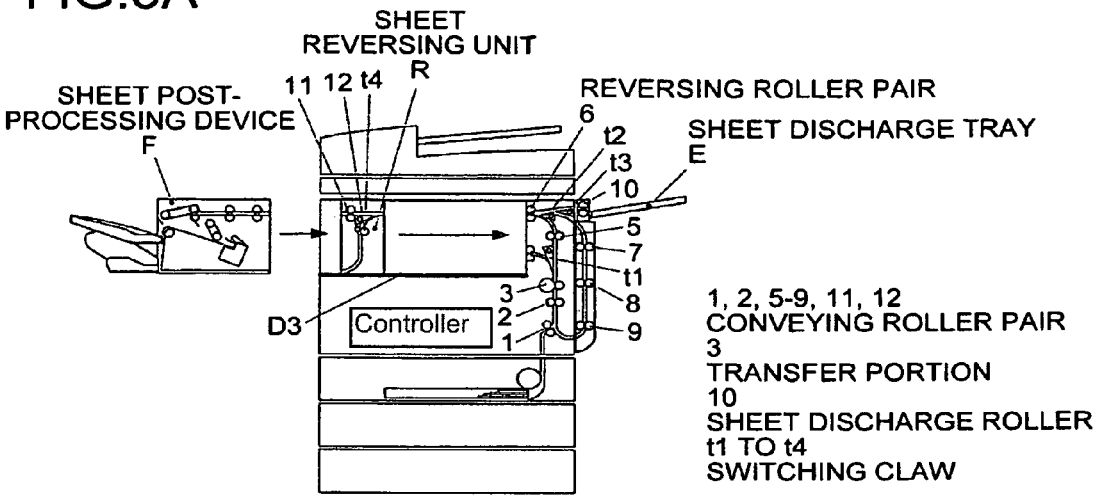
FIGS. 3A to 3C are schematics for explaining how to attach a sheet reversing unit and a sheet post-processing device into the space portion according to the embodiment.

To attach the sheet post-processing device into the space portion D, as shown in FIG. 3A, a sheet reversing unit R is first attached into the space portion D, and then a sheet post-processing device F is attached thereinto. At this time, the sheet reversing unit R and the sheet post-processing device F can be temporarily placed on the partition plate D3 for operation, and the both components can be slid as they are on the partition plate D3 to install the components in respective predetermined positions inside the space portion D, which makes the installation operation easier.

Figure 3B:
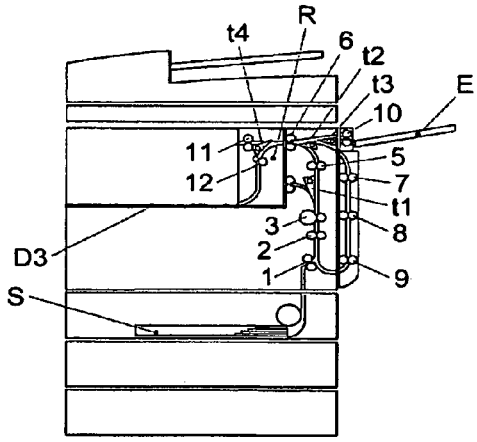
Figure 3C:
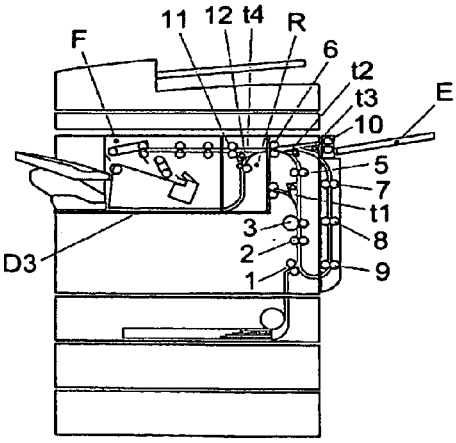

More specifically, as shown in FIG. 3B, first, the sheet reversing unit R that receives the sheet discharged from the reversing roller pair 6 in the image forming unit B upon reversal of the sheet is attached into the space portion D, so that the reversing operation of the sheet is not interrupted even if the space portion D is blocked by the sheet post-processing device. Thereafter, as shown in FIG. 3C, the sheet post-processing device F is attached into the space in the downstream side of the sheet reversing unit R in the sheet conveying direction.

The sheet reversing unit R has two conveying paths, and a switching claw t4 switches between the conveying paths. Conveying roller pairs 11 and 12 being conveying units are provided in the conveying paths to convey the sheet. The conveying roller pair 11 is provided in one of the conveying paths that receives the sheet from the reversing roller pair 6 in the second sheet conveying path and conveys the sheet to the sheet post-processing device F. The conveying roller pair 12 functions as a reversing/conveying roller and is provided in a reversing path to receive the sheet from the reversing roller pair 6 in the second sheet conveying path and reverse the sheet.

The sheet post-processing device F includes a conveying path, a conveying unit, an aligning unit, a binding unit, and a stacking unit, so that an image-formed sheet can be post-processed.

Operations when the sheet post-processing device F is attached to perform the post-processing on the sheet are explained below.

First, operations when the sheet with an image formed on one side thereof is post-processed are explained below with reference to FIGS. 4A to 4C.

Figure 4A:
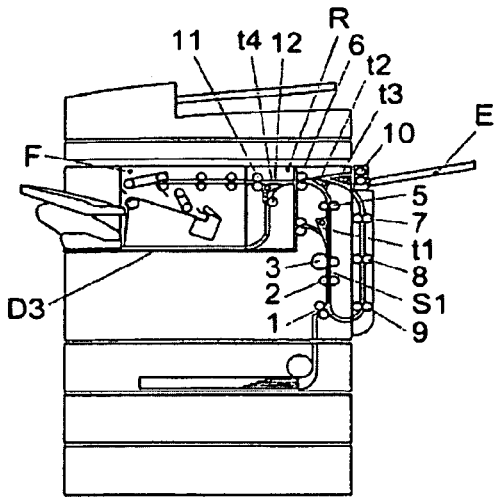
FIGS. 4A to 4C are schematics for explaining operations when an image is formed on one side of a sheet and the sheet is post-processed according to the embodiment.
Figure 4B:
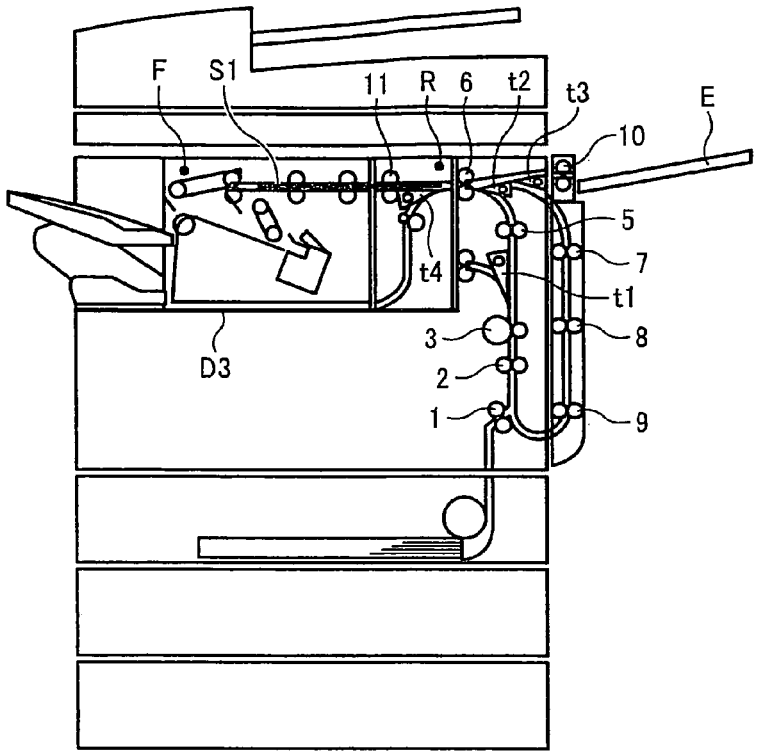
Figure 4C:
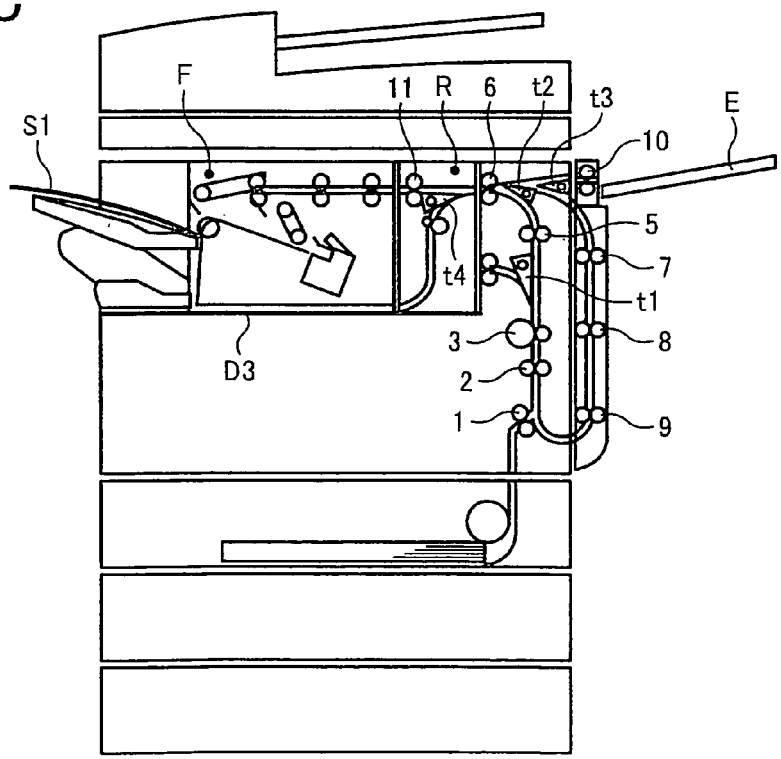

As shown in FIG. 4A, the sheet S is conveyed by the conveying roller pairs 11 and 12 in the first sheet conveying path to the image transfer portion 3 in the image forming unit B, where an image is formed on the sheet S. The image-formed sheet S1 is guided by the switching claws t1 and t2 and is conveyed by the conveying roller pair 5 and the reversing roller pair 6 into the sheet reversing unit R. As shown in FIG. 4B, the sheet S1 is conveyed to the sheet post-processing device F by the switching claw t4 and the conveying roller pair 11 in the sheet reversing unit R, where the sheet S1 is post-processed, and is then sequentially stacked on the stacking tray as shown in FIG. 4C.

Operations when the sheet with images printed on both sides thereof is post-processed are explained below with reference to FIGS. 5A to 5E.

Figure 5A:
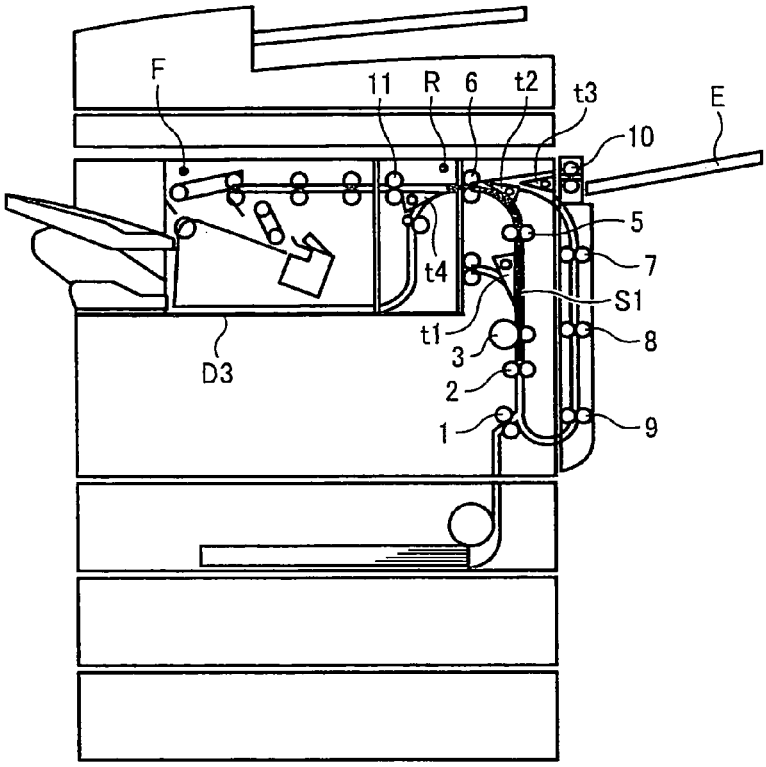
FIGS. 5A to 5F are schematics for explaining operations when a sheet with images formed on both sides thereof is post-processed according to the embodiment.

As shown in FIG. 5A, the sheet reversing unit R and the sheet post-processing device F are attached into the space portion D in the image forming apparatus, and the sheet discharge tray E is attached to the right side of the image forming apparatus. The conveying roller pair 12 is provided on the reversing path in the sheet reversing unit R.

Figure 5B:
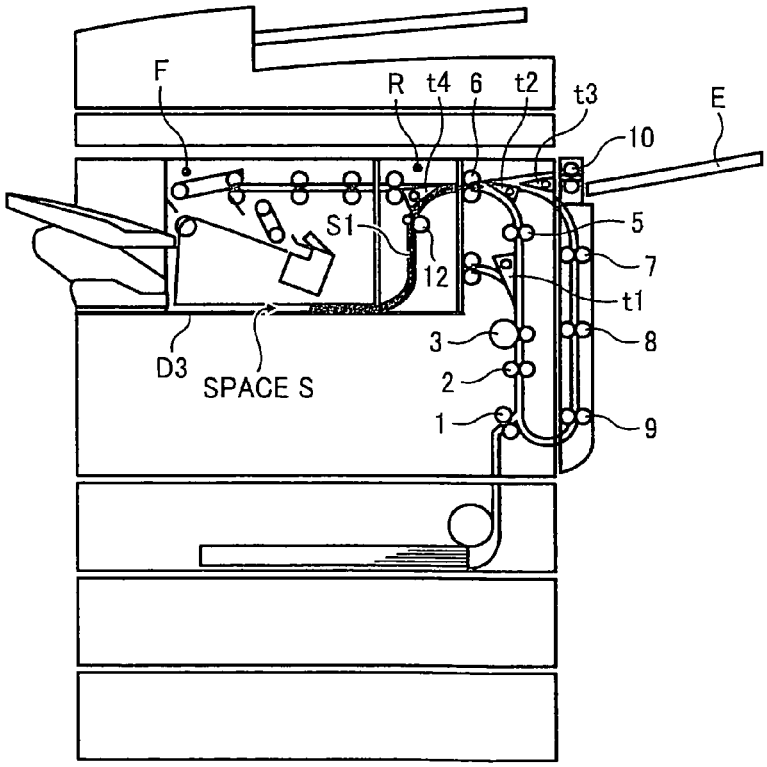

Further, as shown in FIG. 5A, the sheet S1 with an image formed on one side thereof at the image transfer portion 3 is guided by the switching claws t1 and t2 and is conveyed by the conveying roller pair 5 and the reversing roller pair 6 into the sheet reversing unit R, as shown in FIG. 5B. At this time, the sheet S1 is conveyed, by the switching claw t4 in the sheet reversing unit R, into a reversing path which is different from the conveying path to the sheet post-processing device F. Then, the leading edge of the sheet S1 enters a space S formed by the lower part of the sheet post-processing device F and the partition plate D3. At this time, the upper surface of the partition plate D3 functions as a sheet conveying surface and guides the sheet S1.

Figure 5C:
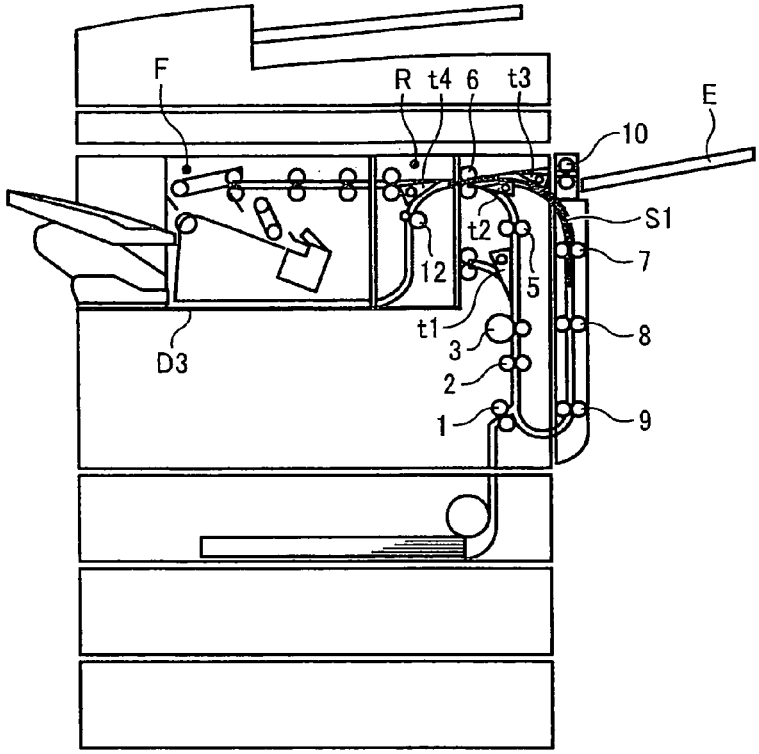
Figure 5D:
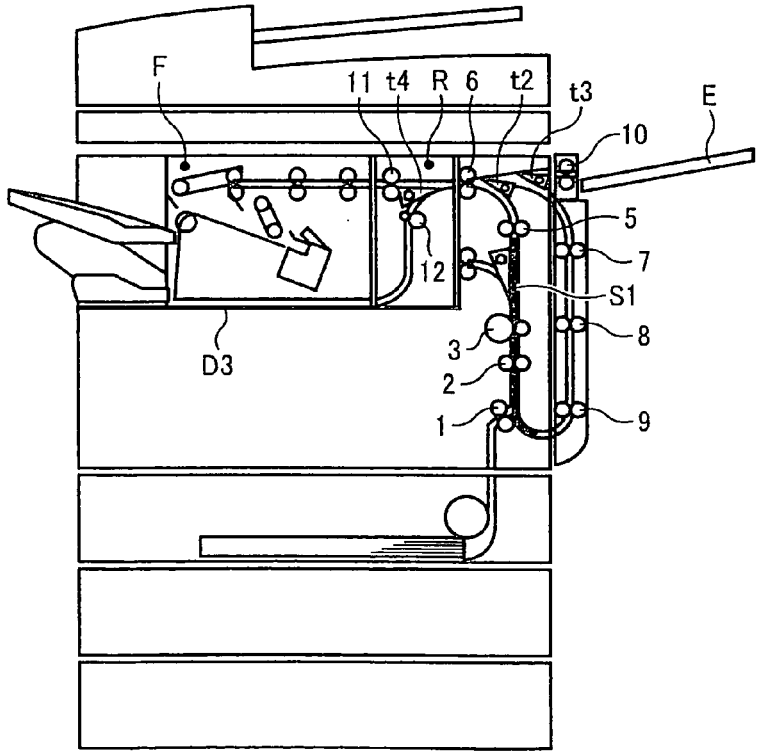
Figure 5E:
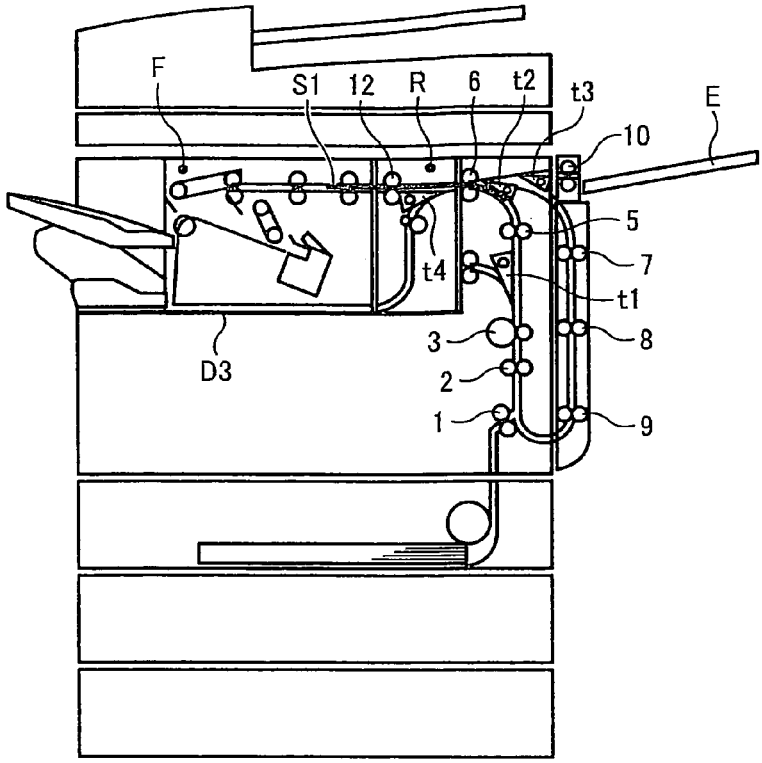

When the trailing edge of the sheet S1 passes through the switching claw t2, the switching claw t2 is switched and further the reversing roller pair 6 is reversed. As shown in FIG. 5C, the sheet S1 is switched back to be conveyed to the vertical reversing path being the second sheet conveying path in the image forming unit B. Thereafter, as shown in FIG. 5D, an image is formed on the other side of the sheet S1 at the image transfer portion 3 in the first sheet conveying path. As shown in FIG. 5E, the sheet S1 is again conveyed to the sheet reversing unit R, and the switching claw t4 is switched so that the sheet S1 is conveyed into the sheet post-processing device F.

Figure 5F:
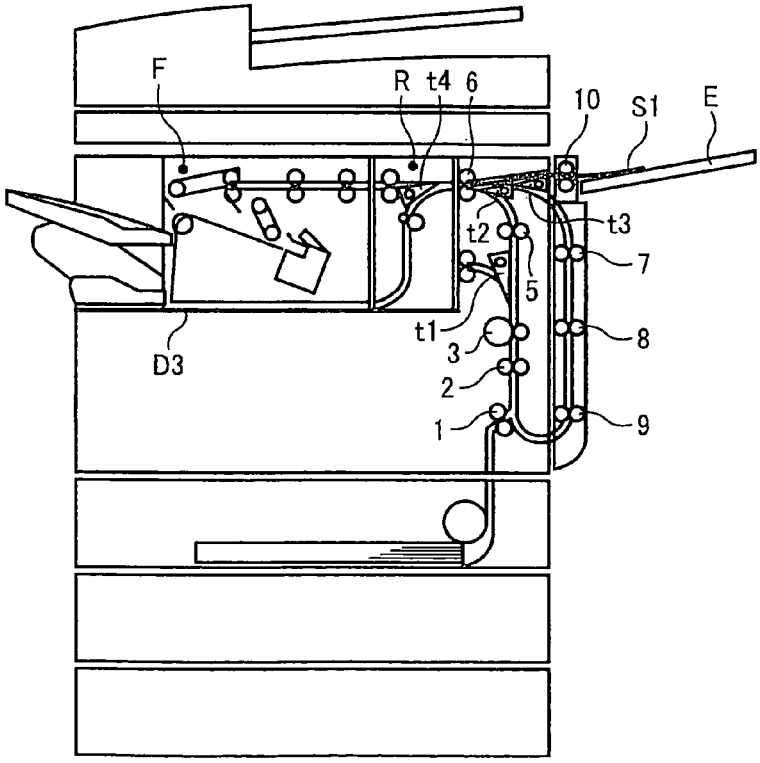

Next, a sheet discharge operation when the sheet discharge tray E is attached to the image forming apparatus is explained with reference to FIGS. 5A, 5B, and 5F.

Similarly to the case of forming images on both sides of the sheet S1, as shown in FIGS. 5A and 5B, the sheet S1 with an image formed thereon at the image transfer portion 3 in the image forming unit B is conveyed into the sheet reversing unit R by the reversing roller pair 6 through the switching claw t1, the conveying roller pair 5, and the switching claw t2. Then, the leading edge of the sheet S1 enters the space S formed by the lower part of the sheet post-processing device F and the partition plate D3 provided on the lower surface of the space portion D.

When the trailing edge of the sheet S1 passes through the switching claw t2, the switching claw t2 is switched and further the reversing roller pair 6 is reversed. As shown in FIG. 5F, the sheet S1 is switched back to be conveyed to a right-side conveying path being a third sheet conveying path in the image forming unit B. The sheet S1 is sequentially stacked on the sheet discharge tray E with its imaged side down by the sheet discharge roller 10 through the switching claw t3.

Figure 6:
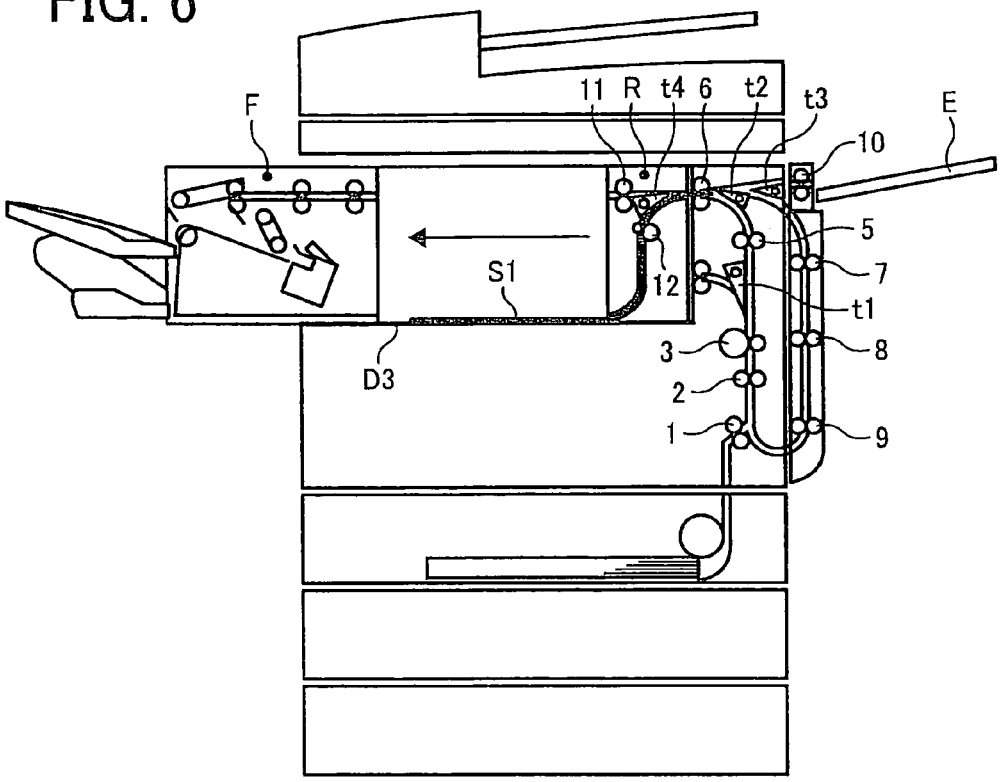
FIG. 6 is a schematic for explaining an operation how to fix a paper jam according to the embodiment.

If the sheet S1 causes a paper jam when it is reversed, as shown in FIG. 6, the sheet post-processing device F is slid and moved to the outside. Thus, the paper jam can be easily checked and the sheet S1 can be removed from the location of the paper jam.

Figure 7:
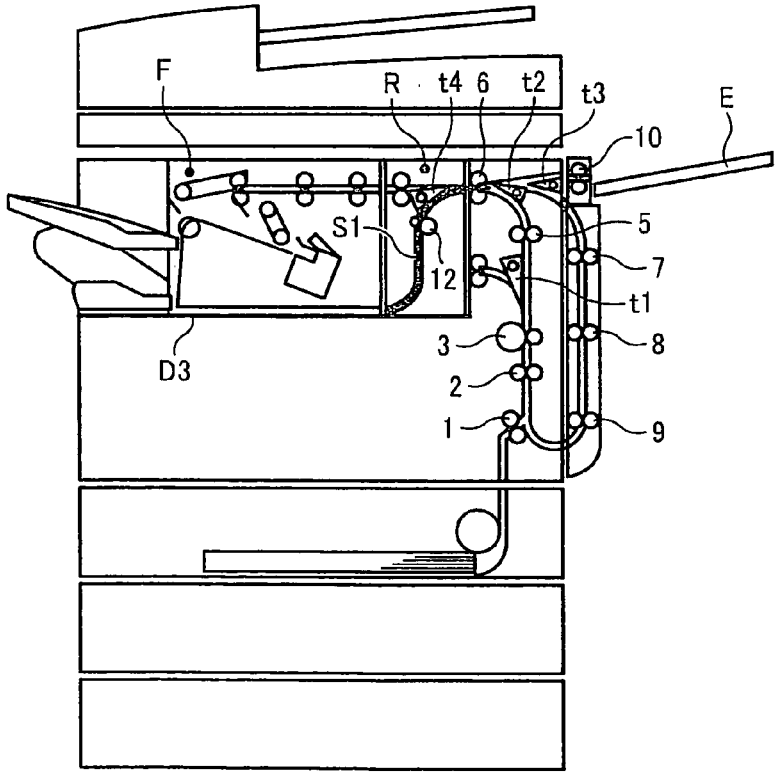
FIG. 7 is a schematic for explaining a support for sheet conveyance when the sheet is reversed by a conveying roller pair according to the embodiment.

In the embodiment, when a thick or a hard sheet of paper is conveyed within a curved reversing path in the sheet reversing unit R, a conveyance resistance is made high, and the sheet is thereby difficult to be conveyed. In this case, as shown in FIG. 7, the conveying roller pair 12 imparts sheet conveyance force to the sheet S1, which can support the conveyance of the sheet S1 upon its reversal.

Moreover, a controller and control software that perform operations and controls of the sheet reversing unit R including the conveying roller pair 12 and of the sheet post-processing device F are provided in the sheet post-processing device F. Thus, minimum necessary controller and control software are only required of the image forming apparatus.

When the sheet fed from the reversing roller pair 6 in the image forming unit B is received by the conveying roller pair 12 in the reversing path, or when the sheet is between the reversing roller pair 6 and the conveying roller pair 12, the reversing roller pair 6 may be accelerated or decelerated to cause a slight difference in speed between the two roller pairs 6 and 12.

Figure 8A:
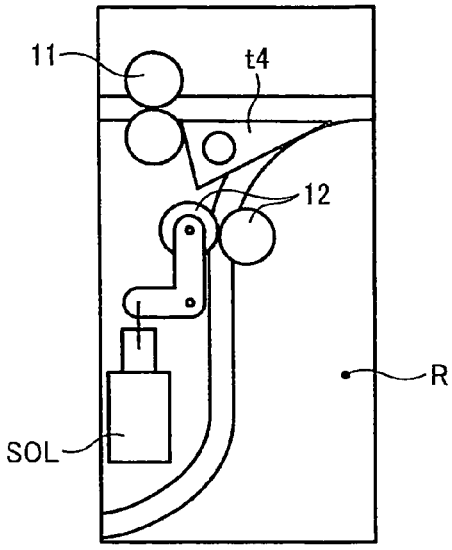
FIGS. 8A and 8B are schematics for explaining a contact/separation structure of the conveying roller pair in the embodiment.
Figure 8B:
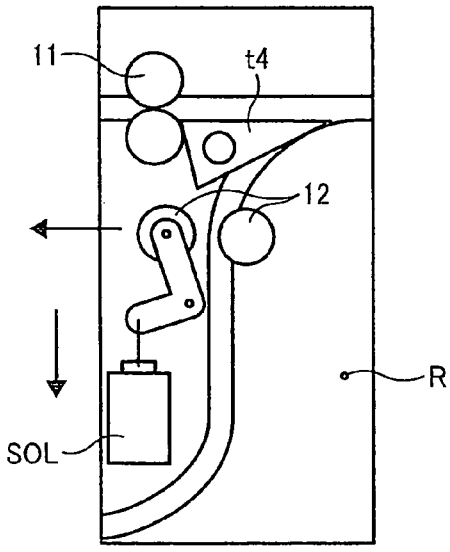

In the embodiment, therefore, as shown in FIGS. 8A and 8B, a solenoid device SOL or the like is used so that a pair of rollers can be contacted/separated with/from each other, the pair of rollers including a drive roller and a driven roller that form the conveying roller pair 12. The conveying roller pair 12 is mutually separated from each other, which enables damage given to the sheet due to the difference in speed to be avoided. Furthermore, if one of the conveying roller pair 12, for example, the driven roller is set as a roller to separate from the other and is driven by the solenoid device SOL, then the rollers can easily be separated from each other.

Figure 9:
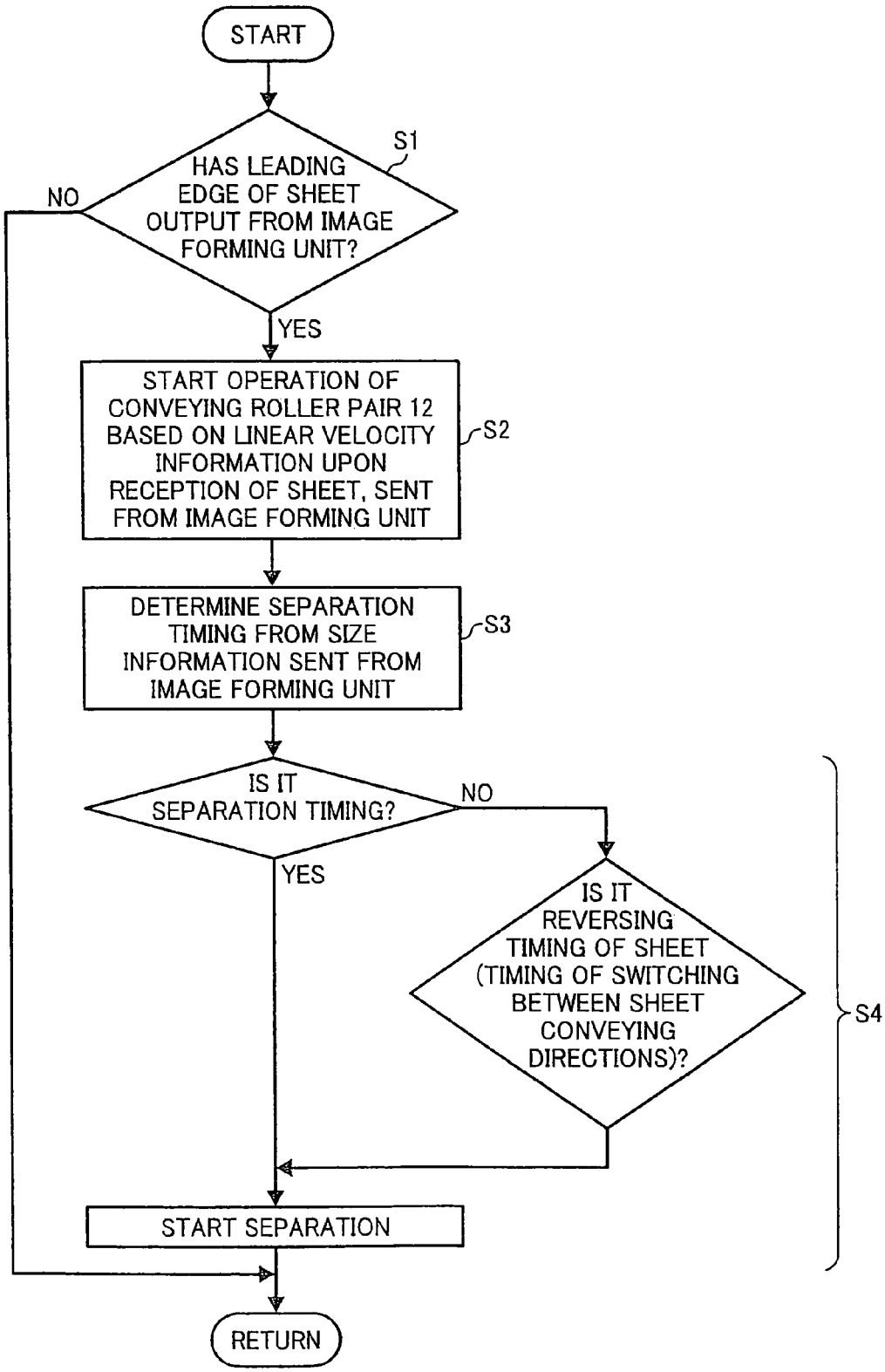
FIG. 9 is a flowchart of reversing operation and timing according to the embodiment.

A reversing operation according to the embodiment is explained below with reference to the flowchart in FIG. 9.

When the leading edge of the sheet to be reversed is sent to the reversing roller pair 6 in the image forming unit B (Step S1), the switching claw t4 is caused to operate so as to be on standby for guiding the sheet to the reversing path in the sheet reversing unit R. The sheet reversing unit R determines a linear velocity upon reception of the sheet based on linear velocity information sent from the image forming unit B, and rotates the conveying roller pair 12 (Step S2).

Furthermore, the sheet reversing unit R determines separation timing of the driven roller of the conveying roller pair 12 from the other by the solenoid device SOL based on size information for the sheet sent from the image forming unit B (Step S3). In the image forming apparatus, when the sheet is in a fixing unit (not shown) that fixes the formed image on the sheet, the sheet is conveyed at a regular linear velocity for image forming process, however, when the sheet passes through the fixing unit, the linear velocity is accelerated to a linear velocity for sheet discharge.

At this time, synchronization between operations is difficult because the components are differently driven, and thus, in the embodiment, the separation operation is implemented under the following three conditions (Step S4).

(1) If the size of the sheet is such that the sheet reaches the conveying roller pair 12 before the acceleration is started, then the sheet is received at the linear velocity for image forming process, and the driven roller of the conveying roller pair 12 is separated from the other at a distance of $\chi$ millimeters in front of an acceleration starting point of the sheet. After the separation, the sheet is conveyed by the reversing roller pair 6.

(2) If the size of the sheet is such that the sheet reaches the conveying roller pair 12 after the acceleration is completed, then the sheet is received at the linear velocity for sheet discharge, and the driven roller of the conveying roller pair 12 is separated from the other at a distance of $\chi$ millimeters in front of a sheet stopping point.

(3) If the size of the sheet is such that the sheet reaches the conveying roller pair 12 during the acceleration, then, before the sheet is received by the conveying roller pair 12, the driven roller of the conveying roller pair 12 is separated from the other. After the separation, the sheet is conveyed by the reversing roller pair 6.

When the sheet starts to be switched back, the driven roller of the conveying roller pair 12 is separated from the other by the solenoid device SOL, and at this state, the sheet is again conveyed to the image forming unit B only by the reversing roller pair 6.

In the embodiment, the control system and control software are configured so that respective drive systems of the sheet reversing unit R and the sheet post-processing device F can be mutually, simultaneously controlled, which enables the sheet reversing unit R to receive a subsequent sheet to be reversed and reverse the subsequent sheet even in the middle of performing the post processing on a preceding sheet in the sheet post-processing device F. Thus, the sheet can be post-processed without decrease in entire productivity of the image forming and sheet processing system.

Moreover, even if the paper jam occurs inside the sheet post-processing device F and conveyance of the sheet is stopped therein, the sheet reversing unit R receives the sheet discharged from the reversing roller pair 6 in the image forming unit B and reverses the sheet, and then switches back the sheet to be conveyed from the right-side conveying path in the image forming unit B to the sheet discharge tray E. Thus, the sheet can be discharged without disturbing the printing order and stacked thereon. Besides, even if the sheet post-processing device F is stopped due to some malfunction, the sheet can be conveyed to the sheet discharge tray E, and thus system down can be prevented.

Because regular jobs related to image control are executed in the image forming apparatus, even if the sheet is continuously stopped during the reversing operation within the reversing path in the sheet reversing unit R when printing and conveying of the sheet are temporarily stopped, the system has to be designed so as not to determine the stoppage as a paper jam according to the control system. Thus, even if the sheet is stopped in the sheet reversing unit R, the control can be performed in the image forming apparatus and can also performed with a specified number of sheets, which is useful in maintenance and improvement of image quality. Therefore, when the image control is finished and printing and conveying of the sheet are restarted in the image forming apparatus, then the reversing operation of the sheet is restarted.

However, when a stop instruction is output in a state in which the sheet is stopped during the reversing operation, any malfunction may occur in the sheet processing system. Therefore, the processes at normal times are caused to interrupt, and "remaining-sheet check process" and "remaining-sheet detection process" are performed as processes upon malfunction. For example, it is detected whether any sheet remains within the sheet conveying path, and if the sheet is detected, then a massage indicating that the sheet remains is displayed or a message prompting the user to remove the sheet is displayed.

Figure 10A:
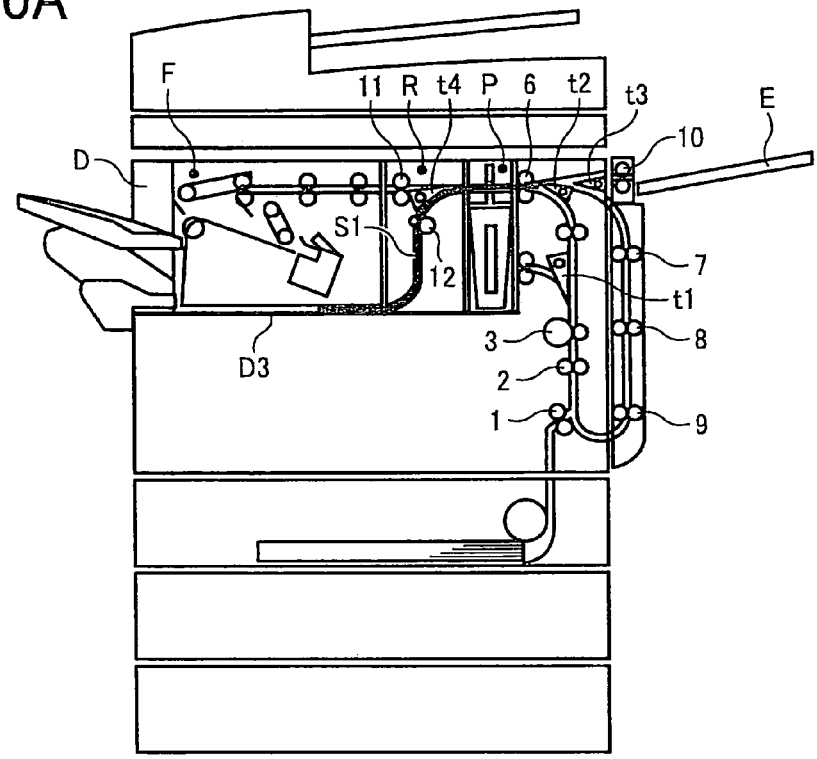
FIGS. 10A and 10B are schematics of configuration examples when a punch unit is provided in a conveying path according to the embodiment.
Figure 10B:
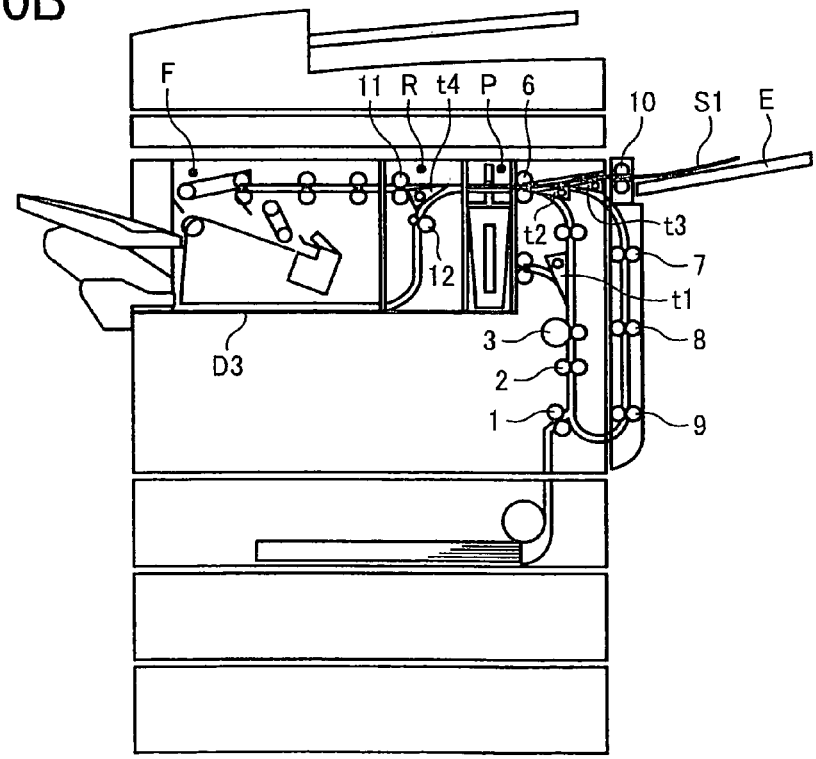
Figure 11:
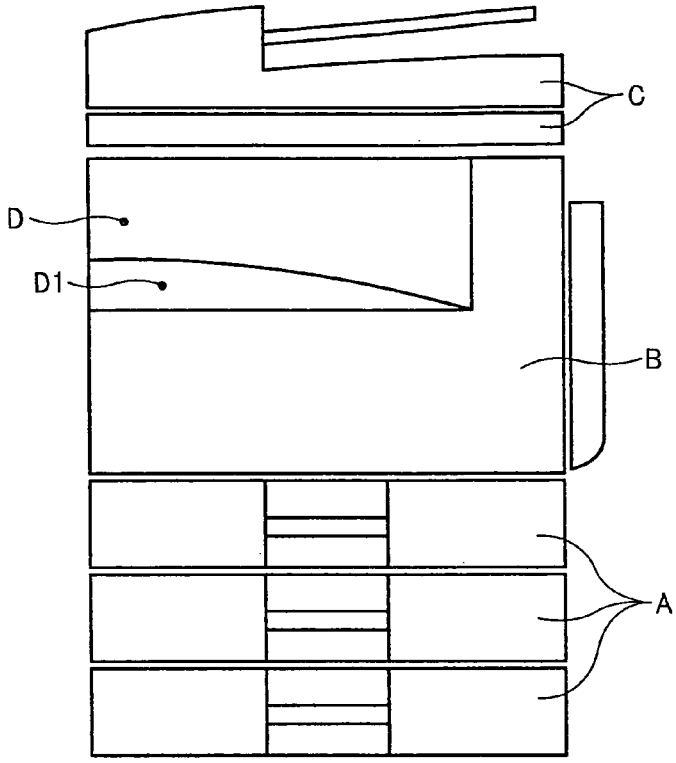
FIG. 11 is a front view of an external configuration of the conventional image forming apparatus.

FIG. 10A represents a state in which a punch unit P that punches a hole or holes in the sheet is attached into the space portion D in the image forming apparatus together with the sheet reversing unit R and the sheet post-processing device F, and in which the sheet discharge tray E is attached to the right side surface of the image forming apparatus. As explained above, if the punch unit P is attached into between the reversing roller pair 6 in the image forming unit B and the sheet reversing unit R and if the reversing path is formed with the punch unit P and the sheet conveying path in the sheet reversing unit R, as shown in FIG. 10B, when the sheet is reversed by the sheet reversing unit R, the hole is punched in the sheet by the punch unit P, and the sheet with the hole can be discharged to the sheet discharge tray E.

According to one aspect of the present invention, a sheet reversing path is installed in the space portion in the sheet pre-processing device, which prevents the entire system from being increased in size even if the sheet post-processing device is installed in the space portion, and even the sheet long in the conveying direction can be reversed without letting it out of the device. Thus, even if a paper jam occurs inside the reversing path, the paper jam can be easily fixed.

Furthermore, according to another aspect of the present invention, the space between the sheet post-processing device and the sheet pre-processing device is used as a guide of the reversing path, which allows space saving and reduction in the number of components.

Moreover, according to still another aspect of the present invention, the partition member can prevent dropping of the sheet or of any foreign matter from the space portion.

Furthermore, according to still another aspect of the present invention, the partition member can be used as a work table upon placement of the sheet post-processing device.

Moreover, according to still another aspect of the present invention, the sheet can be discharged onto the sheet tray other than the space portion, so that convenience for users is increased.

Furthermore, according to still another aspect of the present invention, it is possible to select a state of the sheet when it is discharged and a discharge position of the sheet.

Moreover, according to still another aspect of the present invention, the reversing/conveying roller supports the conveyance of the sheet, so that a stable reversing operation is performed.

Furthermore, according to still another aspect of the present invention, there is no need to provide the controller required for operation control of the sheet post-processing device and the reversing path in the side of the sheet pre-processing device.

Moreover, according to still another aspect of the present invention, the operation timing with the other components or the operation timing between the rollers, and a dimension error or the like can be appropriately controlled.

Furthermore, according to still another aspect of the present invention, an acceleration/deceleration control for driving the rollers upon delivery of the sheet is stabilized, so that excellent conveyance is performed without any damage given to the sheet.

Moreover, according to still another aspect of the present invention, a preceding sheet and a subsequent sheet can be simultaneously processed, which prevents degradation in productivity.

Furthermore, according to still another aspect of the present invention, even if the malfunction occurs during the post-processing for the sheet, an operation such as sheet conveyance other than the post-processing for the sheet can be executed.

Moreover, according to still another aspect of the present invention, even if the sheet is stopped in the reversing path due to some processes in the pre-processing, this stoppage is not determined as a paper jam. Thus, it is possible to prevent any unnecessary operation such as a request for removal of the sheet.

Furthermore, according to still another aspect of the present invention, a punching process becomes possible without being performed by the sheet post-processing device.

Moreover, according to still another aspect of the present invention, even if the sheet post-processing device or the like can be removably attached into the space portion of the sheet pre-processing device, by installing the reversing path of the sheet in the space portion of the sheet pre-processing device, the entire system can be prevented from being increased in size, and even a sheet long in the conveying direction can be reversed without letting it out of the image forming apparatus. Thus, the practical effect is so significant that the paper jam can be easily fixed even if it occurs within the reversing path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing system including a sheet pre-processing device that includes a space portion as a sheet receiving unit that receives a pre-processed sheet, a first sheet conveying path for discharging the sheet to the sheet receiving unit, and a second sheet conveying path for reversing the sheet after a part of the sheet is discharged to the sheet receiving unit, and a sheet post-processing device that is removably attached into the space portion, the sheet processing system comprising:

a conveying path for receiving the sheet from the second sheet conveying path and conveying the sheet to the sheet post-processing device when the sheet post-processing device is attached into the space portion;

a reversing path for receiving the sheet from the second sheet conveying path and reversing a sheet conveying direction when the sheet post-processing device is attached into the space portion;

a switching unit that switches over the sheet conveying direction to either one of the conveying path and the reversing path; and a reversing/conveying roller that can be rotated forwardly and reversely on the reversing path, wherein the reversing/conveying roller is formed with a pair of rollers that can be brought into contact with or separated from each other, and wherein a controller is configured to control the pair of rollers forming the reversing/conveying roller is implemented in such a manner that the pair of rollers are not separated from each other when a delivery linear velocity between a reversing roller provided in the second sheet conveying path for reversing the sheet and caused to rotate forwardly and reversely and the reversing/conveying roller is constant, and that when the pair of rollers are accelerated or decelerated, the pair of rollers are separated from each other before an acceleration or a deceleration is started.

2. The sheet processing system according to claim 1, wherein a space formed between a bottom surface of the sheet post-processing device and a lower surface of the space portion in the sheet pre-processing device is used as a part of the reversing path.

3. The sheet processing system according to claim 1, further comprising a partition member provided on the lower surface of the space portion.

4. The sheet processing system according to claim 3, wherein the partition member functions as a sheet conveying surface.

5. The sheet processing system according to claim 3, wherein the partition member functions as a plate on which the sheet post-processing device is placed.

6. The sheet processing system according to claim 1, further comprising:

a third sheet conveying path for discharging a reversed sheet, other than the space portion of the sheet pre-processing device; and a sheet tray for receiving the reversed sheet from the third sheet conveying path.

7. The sheet processing system according to claim 6, wherein the reversed sheet can be discharged to either one of the space portion as the sheet receiving unit and the sheet tray.

8. The sheet processing system according to claim 1, wherein the sheet post-processing device includes the controller that controls the reversing/conveying roller and the switching unit.

9. The sheet processing system according to claim 1, wherein the control function of the controller of the reversing/conveying roller and the switching unit is simultaneously performed with a control of the sheet post-processing device.

10. The sheet processing system according to claim 1, wherein even when a post-processing error occurs, the controller included in the sheet post-processing device controls the reversing/conveying roller and the switching unit.

11. The sheet processing system according to claim 1, wherein a stoppage of the sheet on the reversing path during an operation of the sheet pre-processing device is not detected as a paper jam.

12. The sheet processing system according to claim 11, further comprising a punch unit that punches a hole in the sheet on the reversing path.

13. The sheet processing system according to claim 1, further comprising a punch unit that punches a hole in the sheet on the reversing path.

* * * * *